US007829792B2

(12) United States Patent
Pons et al.

(10) Patent No.: US 7,829,792 B2
(45) Date of Patent: Nov. 9, 2010

(54) FIRE-RESISTANT SAFETY CABLE PROVIDED WITH A SINGLE INSULATING COVERING

(75) Inventors: Jean-Louis Pons, Saint Serotin (FR); Thierry Jorand, Marle (FR)

(73) Assignee: Prysmian Energie Cables et Systemes France, Sens Cedex (FR)

( * ) Notice: Subject to any disclaimer, the term of this patent is extended or adjusted under 35 U.S.C. 154(b) by 281 days.

(21) Appl. No.: 11/989,302

(22) PCT Filed: Jul. 29, 2005

(86) PCT No.: PCT/FR2005/001987

§ 371 (c)(1),
(2), (4) Date: Jan. 24, 2008

(87) PCT Pub. No.: WO2007/014983

PCT Pub. Date: Feb. 8, 2007

(65) Prior Publication Data

US 2009/0078446 A1 Mar. 26, 2009

(51) Int. Cl.
*H01B 7/00* (2006.01)

(52) U.S. Cl. ..... 174/110 R; 174/113 R

(58) Field of Classification Search ..... 174/110 R, 174/110 N, 110 PM, 110 FC, 120 R, 120 AR, 174/120 SR, 121 A, 36
See application file for complete search history.

(56) References Cited

U.S. PATENT DOCUMENTS 4,694,030 A * 9/1987 von Bonin et al. ..... 523/179
5,173,960 A 12/1992 Dickinson
5,209,987 A 5/1993 Penneck et al.
5,770,820 A * 6/1998 Nelson et al. ..... 174/113 R
6,392,153 B1 * 5/2002 Horwatt et al. ..... 174/110 R
2004/0050578 A1 3/2004 Hudson

FOREIGN PATENT DOCUMENTS

| | | |
|---|---|---|
| EP | 0017609 | 10/1980 |
| EP | 0942439 | 9/1999 |
| FR | 2654867 | 5/1991 |
| JP | 64-030106 | 2/1989 |
| JP | 01-117204 | 5/1989 |
| WO | WO 01/61711 A1 * | 8/2001 |

* cited by examiner

*Primary Examiner*—William H Mayo, III
(74) *Attorney, Agent, or Firm*—Harness, Dickey & Pierce, P.L.C.

(57) ABSTRACT

A fire-resistant safety cable may include at least two electrical conductors separated from each other by at least one space. The cable may include a common insulating layer surrounding the at least two electrical conductors, the common insulating layer being formed from at least one polymeric material that is adapted to be converted, at least on a surface of the at least one polymeric material, to a ceramic state at high temperatures in a fire. The cable may include an outer jacket. The outer jacket may surround the common insulating layer. The cable may have, in cross-section, at least two substantially plane faces that are substantially parallel to a plane in which axes of the at least two electrical conductors lie. A process for manufacturing the cable may include feeding the at least two electrical conductors into an extrusion head and extruding the at least one polymeric material over them.

20 Claims, 5 Drawing Sheets

FIRE-RESISTANT SAFETY CABLE PROVIDED WITH A SINGLE INSULATING COVERING

CROSS-REFERENCE TO RELATED APPLICATIONS

This application is a national stage entry from International Application No. PCT/FR2005/001987, filed on Jul. 29, 2005, in the Receiving Office of the National Institute of Industrial Property (France), the entire contents of which are incorporated herein by reference.

BACKGROUND

1. Field

The present invention relates to a fire-resistant safety cable. In particular, the present invention relates to a fire-resistant cable that comprises at least two electrical conductors surrounded by a common insulating layer.

More particularly, the present invention relates to a substantially flat fire-resistant cable, which comprises at least two electrical conductors that are adjacent one another and are surrounded by a common insulating layer.

2. Description of Related Art

Safety cables are especially power-transporting or data-transmitting cables, such as for control or signaling applications.

Fire-resistant safety cables must, in a fire, maintain an electrical function. Preferably, said cables must also not propagate the fire. Said safety cables are used for example for lighting emergency exits and in elevator installations.

Fire-resistant cables must meet the criteria, for example set by the French standard NF C 32-070. According to this standard, the cable is placed horizontally in a tube furnace, the temperature of which is raised to 920° C. and held there for 50 minutes. The cable must not undergo a short circuit during this temperature rise and during 15 minutes at 920° C. Throughout this time, to simulate the falling of objects in a fire, the cable is periodically subjected to a shock by a metal bar in order to shake the cable.

Cables passing the test defined by NF C 32-070, paragraph 2-3 belong to the CR1 category.

Criteria similar to those defined in French standard NF C 32-070 are also defined by international standards, such as IEC 60331, or European standards, such as EN 50200.

Documents JP 01-117204 and JP 01-030106 disclose two fire-resistant flat cables, said cables comprising several conductors surrounded by an insulator and by a polyethylene outer jacket, the insulating layer of each electrical conductor consisting of mica tapes.

The Applicant has noticed that a fire-resistant cable provided with an insulating layer consisting of mica tapes has several drawbacks. In particular, such a cable may have a gap (or space exposing the conductor) in the mica tape wrapping, thereby causing a fault in the protection of the conductors, leading to a short circuit.

Fire-resistant cables having an approximately round cross section are also known. Such cables may have more than two insulated conductors, at least one insulated conductor being superposed on the others so as to give the cable a round cross section.

For example, document EP 942 439 discloses a fire-resistant halogen-free round safety cable, comprising at least one conductor, an insulator around each conductor, and an outer jacket, empty spaces being provided between said jacket and said insulator of each electrical conductor.

The insulator of each conductor is made of a composition formed from a polymeric material containing at least one ceramic-forming filler capable of being converted, at least on the surface, to the ceramic state at high temperatures corresponding to fire conditions.

The outer jacket is made of a polyolefin composition containing at least one metal hydroxide filler.

However, the fire-resistant cables such as those described above have several drawbacks. For example, in a fire, they have a high risk of the ash resulting from combustion of the outer jacket contaminating the insulating layer.

This is because the outer jacket is generally converted, through the action of a fire, to ash, which may impede the conversion of the polymeric material of the insulator to a ceramic, causing the appearance of cracks in the insulation of the conductor.

Furthermore, the superposition of the insulated conductors may cause the size of the cracks to increase appreciably, resulting in a collapse of the insulating layer(s) contaminated by said ash. These drawbacks result in a reduction in insulating protection provided by the insulating layer(s) of the cable and in an increase in the risk of short-circuiting the conductors. These risks relate in particular to the superposed insulated elements.

Furthermore, this ash may cause the volume and surface conductivity of the insulation to increase, which would impair the proper operation of the cable.

In addition, in a fire, objects such as a beam or elements of a building structure may fall and strike the cable, thus damaging the latter and impairing the mechanical integrity of the insulator, converted to ceramic or in the process of being converted to ceramic, of each conductor. The fall of such an object may cause an insulated conductor to be compressed between said object and another conductor of the same cable, damaging the insulator converted to ceramic or in the process of being converted to ceramic, and thus short-circuiting the two conductors.

There is therefore a need for a fire-resistant cable that alleviates the abovementioned drawbacks.

SUMMARY

The Applicant has found that a fire-resistant cable having a common insulating layer that surrounds the electrical conductors allows the abovementioned drawbacks to be overcome.

One object of the present invention is to provide a fire-resistant safety cable, said cable comprising:

- at least two electrical conductors, said electrical conductors being separated from each other by at least one space;
- a common insulating layer surrounding the electrical conductors and filling said space or spaces, said insulating layer being formed from at least one polymeric material capable of being converted, at least on the surface, to the ceramic state at high temperatures in a fire; and
- an outer jacket surrounding said insulating layer.

This cable is preferably a halogen-free non-fire-propagating cable. The term "halogen-free cable" is understood to mean a cable of which all the constituents are substantially non-halogenated. Even more preferably, the constituents contain no halogen compound.

According to the invention, the cable comprises a common insulating layer that surrounds the conductors and fills the spaces, one space separating two adjacent conductors. Said common insulating layer thus forms a mechanically integral envelope inside which the electrical conductors are included.

Preferably, in cross section, the external outline of the insulating layer of the cable follows substantially the shape of the envelope of the conductors, thereby causing the conductors to be included within the insulating layer.

In more detail, the insulating layer of the cable preferably has a thickness that is approximately constant over the external surface of the electrical conductors and may be reduced to a minimum value sufficient to give the cable a typical protection of an insulating cable layer.

A common insulating layer according to the invention has the advantage of avoiding, in a fire, any ingress of residual ash from the jacket between each insulated conductor during conversion of the insulator to ceramic, and of reducing the appearance of cracks. It also allows better mutual mechanical cohesion of the conductors once the insulator has been converted to ceramic. In this way, the risk of a short circuit between electrical conductors is reduced, while the integrity of the cable is maintained.

The material of the outer jacket preferably comprises an ethylene/vinyl acetate copolymer (or EVA), a polysiloxane, a polyolefin such as polyethylene or a polyvinyl chloride (or PVC), or a blend thereof. The material of the outer jacket may furthermore include mineral fillers capable of being converted to residual ash under the effect of high temperatures in a fire, such as chalk, kaolin, metal oxides such as hydrated alumina, or metal hydroxides such as magnesium hydroxide, metal oxides or hydroxides possibly serving as fire-retardant fillers.

The material of the outer jacket may optionally be expanded, so as to improve in particular the impact resistance of the cable, which cable may be subjected to an impact when an object falls on it in a fire.

The outer jacket may take the form of a single layer or several layers of polymeric material(s), for example 2, 3 or 4 layers. For example, it is possible to give the cable with an appropriate jacket layer for providing a particular technical function, for example for absorbing accidental impacts on the cable or for improving the fluid resistance of the cable.

In the cables of the invention, the insulator is formed in particular from at least one polymeric material capable of being converted, at least on the surface, to the ceramic state at high temperatures in a fire, especially within the range from 400° C. to 1200° C. This conversion to the ceramic state of the polymeric material of the insulator makes it possible for the physical integrity of the cable and its electrical operation to be maintained under fire conditions.

The polymeric material of the insulating layer is preferably a polysiloxane, such as a crosslinked silicone rubber. The insulating layer may furthermore include, preferably, a filler that forms a ceramic under the effect of high temperatures in a fire, such as silica or metal oxides.

According to another embodiment of the present invention, the polymeric material of the insulating layer may be expanded. This expansion may in particular improve the impact resistance of the insulated conductor, which conductor may be subjected to an impact in a fire as a result of an object such as a beam falling onto it.

The insulator may take the form of a single layer or several layers of polymeric material(s), such as 2 or 3 layers or more.

The cable according to the invention, comprising at least two conductors included within one and the same insulating layer, may furthermore include a bulking material between said insulating layer and the outer jacket.

The bulking material is preferably chosen from an ethylene/vinyl acetate copolymer (or EVA), a polysiloxane, a polyolefin such as polyethylene, or a polyvinyl chloride (or PVC), or a blend thereof. The bulking material may furthermore include mineral fillers capable of being converted to residual ash under the effect of high temperatures in a fire, such as chalk, kaolin, metal oxides such as hydrated alumina, or metal hydroxides such as magnesium hydroxide, it being possible for the metal oxides or hydroxides to serve as fire-retardant fillers.

The cable according to the invention may be round or substantially flat in cross section.

A substantially flat cable is a cable that has, in cross section, at least two substantially plane faces that are substantially parallel to the plane in which the axes of the conductors lie. Preferably, the flat cable has an approximately rectangular external profile and, better still, it has, in cross section, at least two substantially plane faces that are substantially parallel to the plane in which the axes of the conductors lie and two substantially rounded lateral portions that are joined to said two faces.

More particularly, a substantially flat cable according to the present invention comprises at least two conductors surrounded by a common insulating layer, which are mutually adjacent and side by side, and their axes lie in one and the same plane between said at least two faces.

Arranging for the axes of the electrical conductors to lie in one and the same plane makes it furthermore possible to increase the electrical strength of the conductors, while reducing any short-circuiting of the conductors.

This is because, in a fire, this particular arrangement of the electrical conductors, allowing the number of regions of contact between the insulated conductors to be limited, in particular for a three-conductor cable, also results in the short-circuiting risks being limited during conversion of the insulator to ceramic or when the insulator is already in ceramic form.

Preferably, the spaces separating the mutually adjacent conductors in a flat cable are distributed transversely to the axis of the cable and have the same dimensions.

Preferably, the substantially flat fire-resistant cable of the present invention includes a cable jacket having an external outline that substantially matches the shape of the insulating layer. For example, for a two-conductor cable, the cable thus has in cross section a "figure of 8" shape.

In more detail, the cable jacket has, in cross section, an external outline (or profile) which substantially follows the shape of the envelope of the insulated conductors located inside the cable jacket, their axes lying in one and the same plane. In other words, the cable jacket preferably has a thickness that is approximately constant over the external surface of the insulated conductors and may be reduced to a minimum value sufficient to give the cable the typical protection of a cable jacket.

In this way, the cable of the present invention leads to a reduction in the amount of jacket material used to produce the cable, especially for two-conductor cables. This results, on the one hand, in a reduction in the manufacturing cost of the cable and, on the other hand, in a reduction in the incandescence time, in the thermal energy released in a fire and the amount of ash resulting from the combustion of the jacket. These aspects are particularly advantageous since the risk of cracks appearing, which may be caused by ash during conversion of the insulator to ceramic at high temperatures in a fire, may be considerably reduced.

Moreover, in the case of three-conductor cables, the external surface of the jacket has a larger area in the present invention, thereby allowing better heat exchange and better and more rapid combustion of the jacket, which will then cause less disturbance to the conversion of the insulator to ceramic in a fire.

Another object of the invention is to provide a process for manufacturing the cables according to the invention, which comprises the extrusion of a polymeric material for the insulator—which is capable of being converted, at least on the surface, to the ceramic state at high temperatures in a fire—over metal conductors that are fed into one and the same extrusion head in such a way that the insulation material deposited in this way makes each conductor thus insulated integral.

BRIEF DESCRIPTION OF THE DRAWINGS

The invention and the advantages that it affords will be better understood thanks to the exemplary embodiments given below by way of nonlimiting indication, these being illustrated by the appended drawings in which.

DETAILED DESCRIPTION OF EXAMPLE EMBODIMENTS

Figure 1:
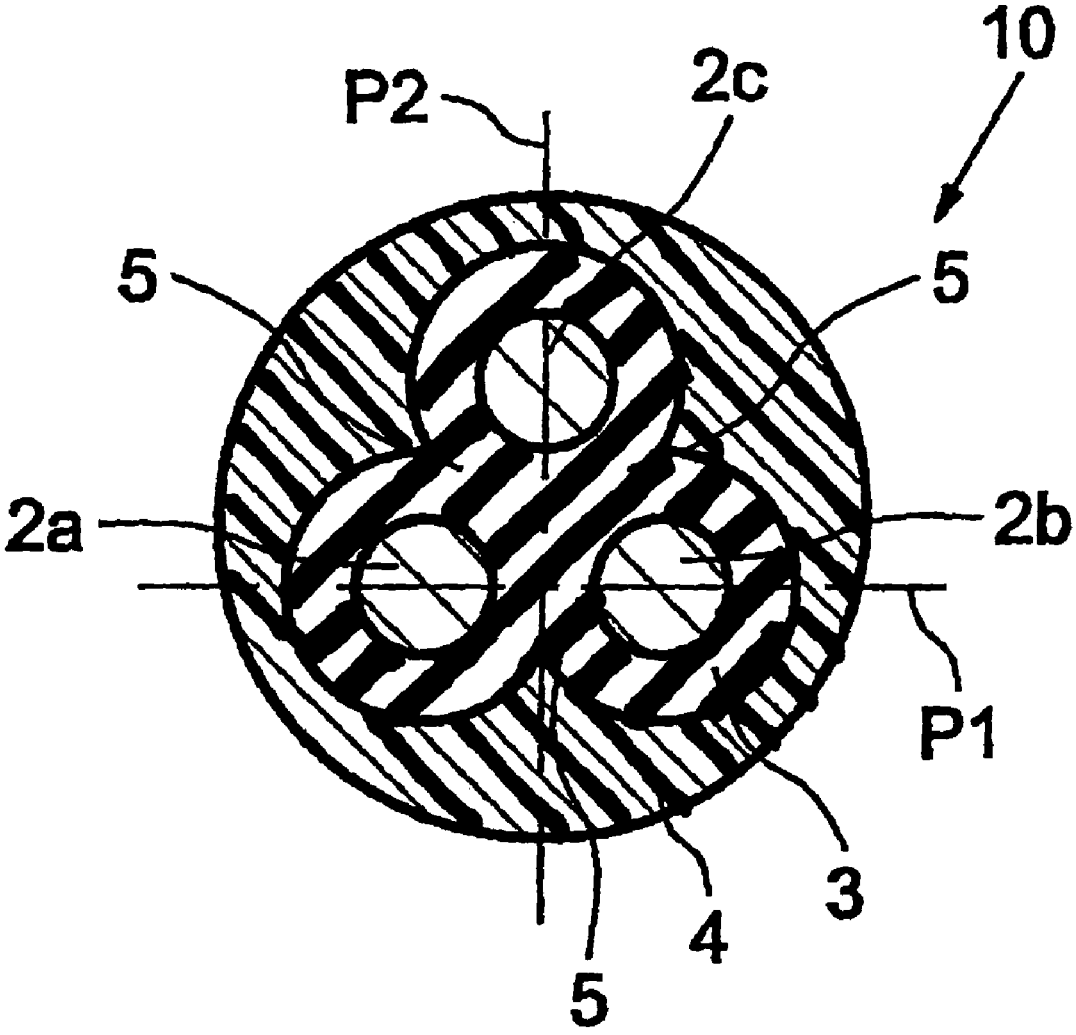
FIG. 1 shows a cross-sectional view of a round cable having three electrical conductors according to a first embodiment.

FIG. 1 shows a round cable 10 having three electrical conductors 2*a*, 2*b* and 2*c*, these extending longitudinally inside a common insulating layer 3.

According to this embodiment, the electrical conductor 2*c* is superposed on the electrical conductors 2*a* and 2*b*. In other words, the axes of the two conductors 2*a* and 2*b* lie parallel to each other in one and the same longitudinal mid-plane P1, whereas the conductor 2*c* is placed above the conductors 2*a* and 2*b*, its axis being parallel to those of the conductors 2*a* and 2*b* and lying in a longitudinal mid-plane P2 perpendicular to P1.

The conductors 2*a*, 2*b*, 2*c* are separated from one another by a space 5. Preferably, the spaces 5 that separate adjacent conductors have identical dimensions. Preferably, the conductors 2*a* and 2*b* lie equidistantly from the plane P2, on either side of the plane P2. In particular, the conductors 2*a* and 2*b* are separated by a space 5 that preferably measures between about 0.1 mm and about 10 mm (transverse dimension).

According to the present invention, the cable 10 comprises a common insulating layer 3 that surrounds the three conductors 2*a*, 2*b* and 2*c*. Consequently, the material of the insulating layer 3 fills the spaces 5 that separate the three conductors, so as to obtain a common insulating layer 3 in the form of a mechanically integral envelope.

In FIG. 1, the insulating layer 3 has an external outline that substantially matches the shape of the envelope of the conductors, said insulating layer having an approximately constant thickness over the external surface of the conductors.

The material of the insulator 3 is preferably a polysiloxane which includes in particular a silica-type reinforcing filler, the insulator 3 preferably comprises a single polysiloxane layer.

The cable 10 shown in FIG. 1 furthermore includes an outer jacket 4 that surrounds the insulating layer 3 so that the cross section of the cable has a circular shape.

The outer jacket 4 preferably consists of an EVA, optionally containing fillers such as metal oxides or hydroxides.

Figure 2:
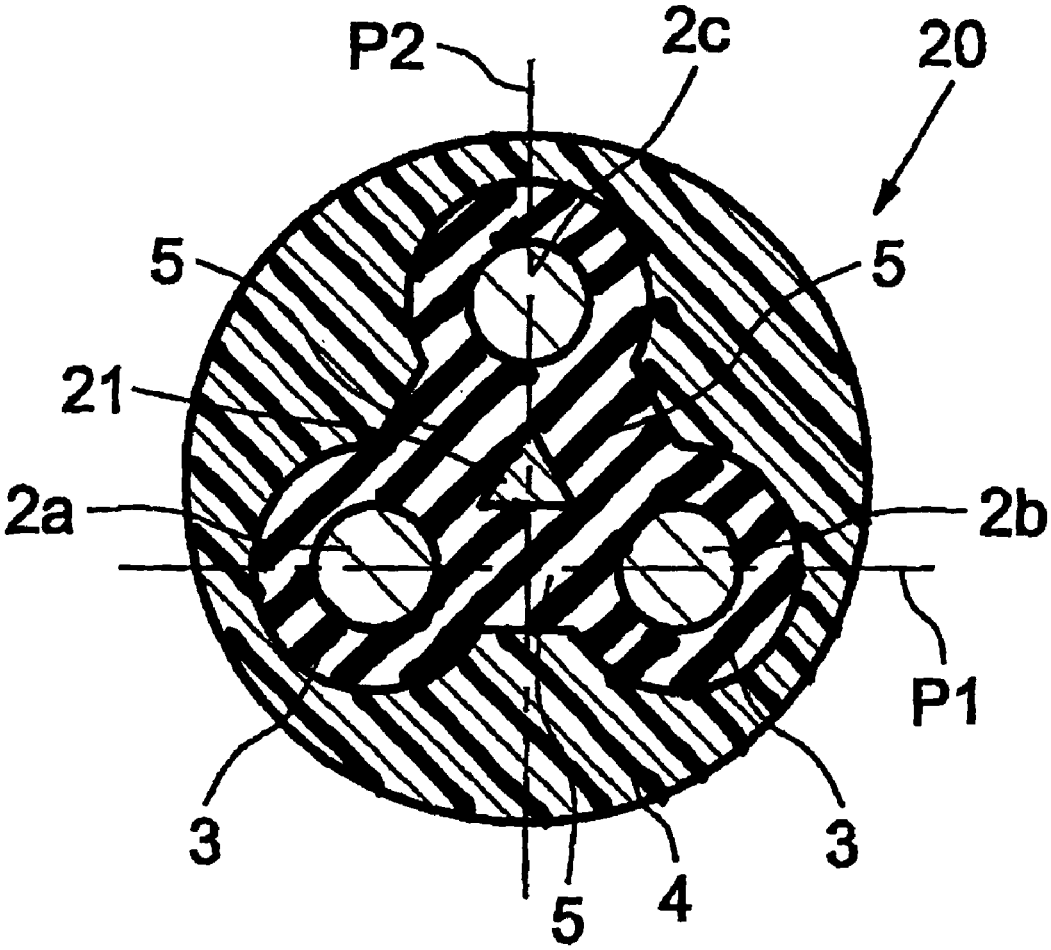
FIG. 2 shows a cross-sectional view of a round cable having three electrical conductors according to a second embodiment.

The cable 20 of FIG. 2 differs from that of FIG. 1 in that an additional space 21 is present between the insulated conductors 2*a*, 2*b*, 2*c*.

The insulated conductors 2*a*, 2*b*, 2*c* are separated from one another by respective spaces 5 and that part of the cable contained between the spaces 5 and the insulated conductors 2*a*, 2*b*, 2*c* defines said additional space 21.

In this second embodiment, the spaces 5 are formed from three segments which link the insulated conductors 2*a* and 2*b*, 2*b* and 2*c*, and 2*c* and 2*a* respectively, said segments consisting of the insulating material of the insulating layer 3.

In cross section, the insulator 3 of the cable 20 is the combination of three annular shapes, two shapes being aligned and the third lying above the other two and in a position centered with respect to the other two. These annular shapes are joined in pairs by a segment made of insulator, for example measuring between 0.1 mm and 20 mm. The insulator then has the shape of an equilateral triangle, preferably with rounded vertices.

The cable 20 has an outer jacket 4 that surrounds the insulating layer 3 and gives the cable a round profile in cross section.

Preferably, the additional space 21 is formed from the same material as that of the outer jacket 4. Alternatively, the additional space 21 may be a void, that is to say it may contain no filling material, so as to increase the separation between the conductors.

Figure 3:
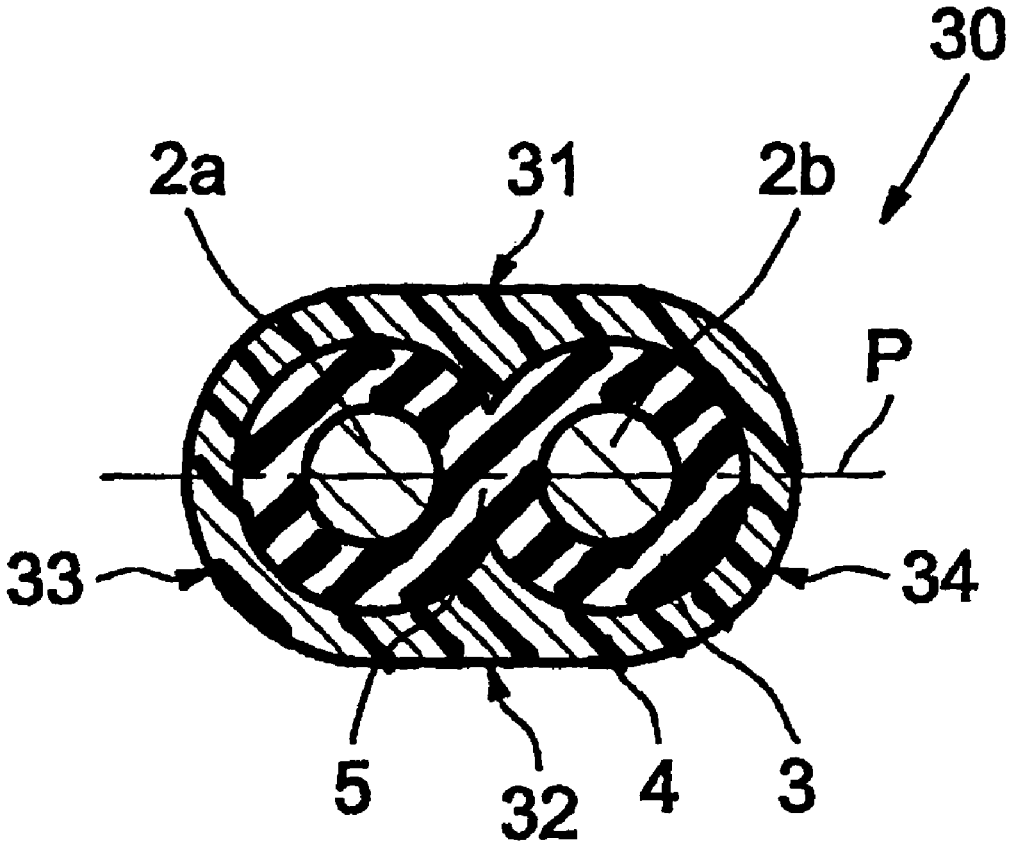
FIG. 3 shows a cross-sectional view of a flat cable having two electrical conductors, according to a third embodiment.

FIG. 3 shows a flat cable 30 according to a third embodiment of the present invention.

This cable 30 comprises two electrical conductors 2*a* and 2*b*, a common insulating layer 3 surrounding the two electrical conductors 2*a* and 2*b*, and an outer jacket 4.

In cross section, the cable has an approximately rectangular external profile comprising two substantially plane faces 31 and 32 substantially parallel to the plane P containing the axes of the conductors, and two substantially rounded lateral portions 33 and 34 which are joined to said two faces 31 and 32.

The two electrical conductors 2*a*, 2*b* are arranged so as to be parallel, one with respect to the other, mutually adjacent and side by side in the longitudinal mid-plane P of the cable 30. The electrical conductors 2*a*, 2*b* are separated by a space 5. This spare 5 measures between about 0.1 mm and 10 mm.

According to this embodiment, the insulator 3 surrounds the two conductors and fills the space 5, thereby obtaining a common insulating layer 3 in the form of a mechanically integral envelope.

According to the embodiment shown in FIG. 3, the insulating layer 3 has an external outline that substantially matches the external outline of the envelope of the conductors 2*a* and 2*b*, said insulating layer 3 having a thickness that is approximately constant over the external surface of the conductors.

The material of the insulator 3 is preferably a polysiloxane which includes in particular a silica-type reinforcing filler. Preferably, the insulator 3 comprises a single layer.

The outer jacket 4, deposited on the insulator 3, preferably consists of an EVA optionally containing fillers such as metal oxides or hydroxides.

Figure 4:
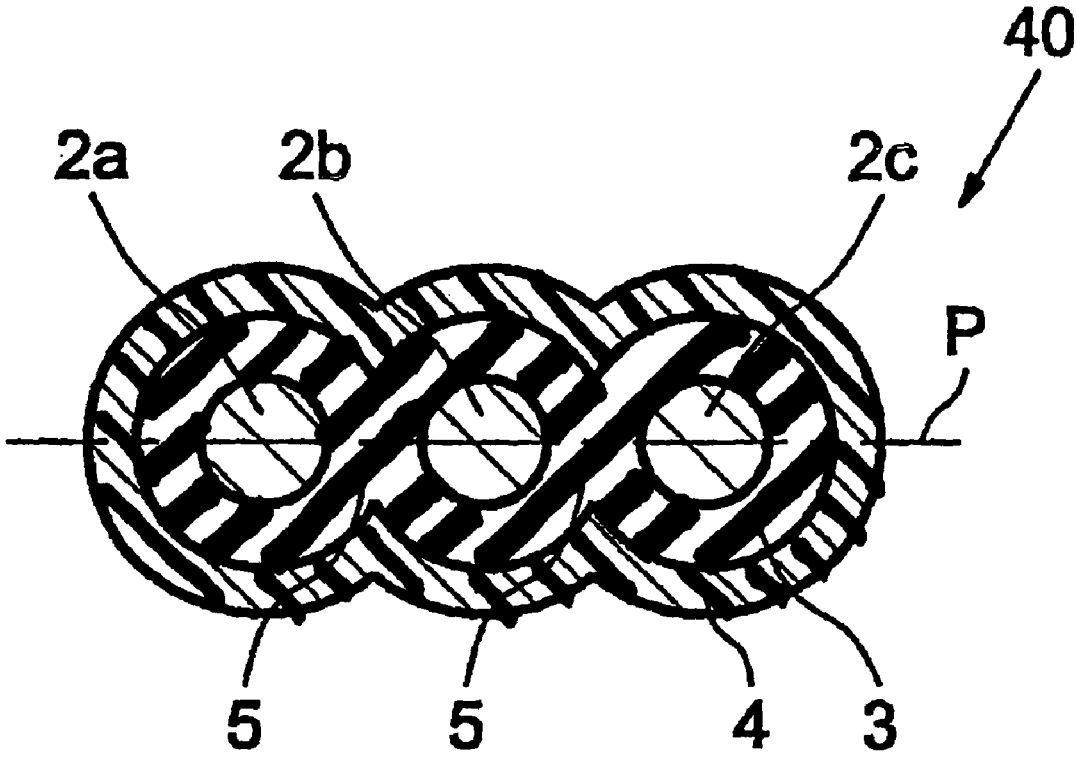
FIG. 4 shows a cross-sectional view of a flat cable having three electrical conductors, according to a fourth embodiment.

The cable 40 of FIG. 4 differs from that of FIG. 3 in that an additional conductor 2*c* is introduced into the insulator 3, in the longitudinal mid-plane P of the cable 1, and in that the external profile of the outer jacket 4 substantially matches the external profile of the insulating layer 3, the outer jacket 4 having a thickness that is approximately constant over the external surface of the insulating layer 3.

Figure 5:
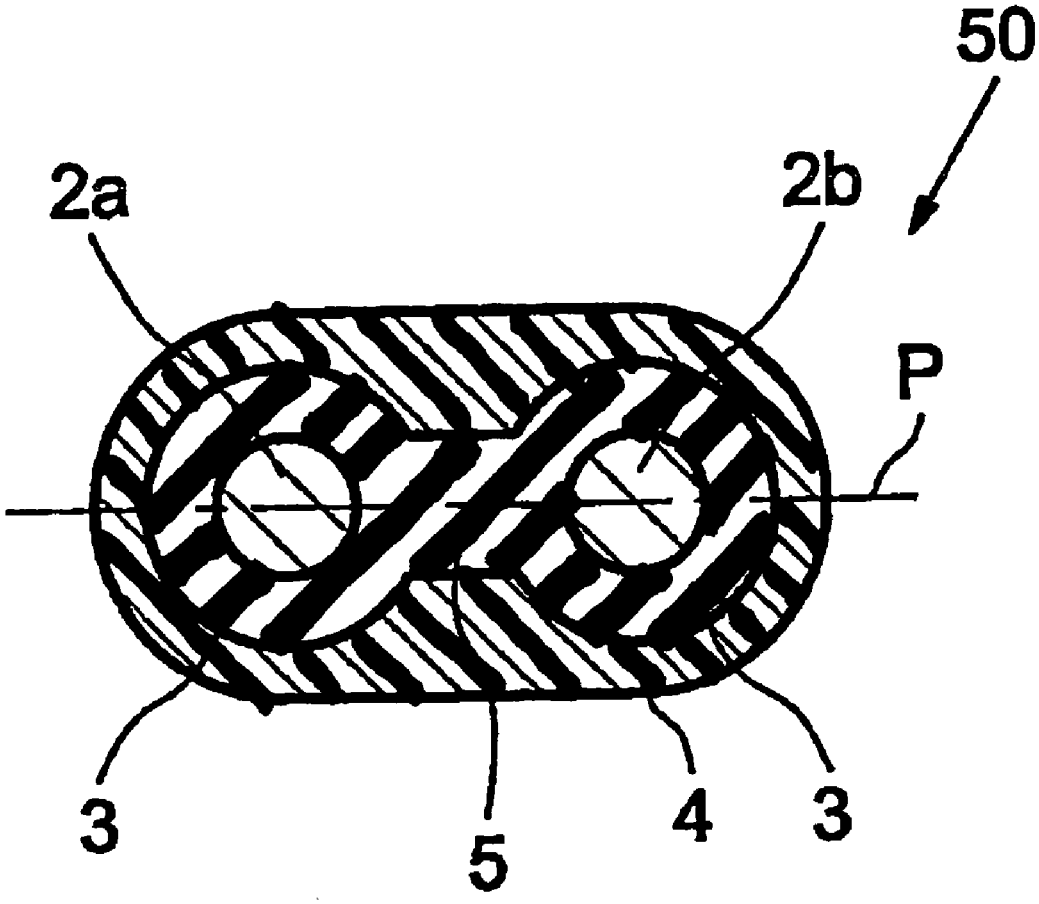
FIG. 5 shows a cross-sectional view of a flat cable having two electrical conductors, according to a fifth embodiment.

The cable 50 of FIG. 5 differs from that of FIG. 3 in that the space 5, which separates the adjacent conductors 2*a*, 2*b*, is elongate so that the distance between said conductors is increased in order to reduce the risk of a short circuit.

For example, the space 5 measures between 0.1 mm and 20 mm.

The invention claimed is:

1. A fire-resistant safety cable, comprising:

at least two electrical conductors separated from each other by at least one space; and an outer jacket;

wherein the cable also comprises a common insulating layer surrounding the at least two electrical conductors and being surrounded by the outer jacket, the common insulating layer filling the at least one space and being formed from at least one polymeric material that is adapted to be converted, at least on a surface of the at least one polymeric material, to a ceramic state at high temperatures in a fire.

2. The cable of claim 1, wherein the common insulating layer forms a mechanically integral envelope including the at least two electrical conductors.

3. The cable of claim 1, wherein the common insulating layer has, in cross-section, an external outline that substantially matches a shape of an envelope of the at least two electrical conductors.

4. The cable of claim 1, wherein the common insulating layer has a thickness that is approximately constant over an external surface of the at least two electrical conductors.

5. The cable of claim 1, wherein the at least one polymeric material is a polysiloxane.

6. The cable of claim 1, wherein the at least one polymeric material comprises:

a filler that forms a ceramic under the effect of the high temperatures in a fire.

7. The cable of claim 1, wherein the at least one polymeric material is expanded.

8. The cable of claim 1, wherein a material of the outer jacket comprises:

one or more of an ethylene/vinyl acetate copolymer, a polysiloxane, a polyolefin, and a polyvinyl chloride.

9. The cable of claim 1, wherein a material of the outer jacket comprises:

mineral fillers adapted to be converted to residual ash under the effect of the high temperatures in a fire.

10. The cable of claim 1, wherein a material of the outer jacket is expanded.

11. The cable of claim 1, wherein the outer jacket comprises:

several layers of polymeric material or materials.

12. The cable of claim 1, wherein an external profile of the cable in cross-section is round.

13. The cable of claim 1, wherein the cable has, in cross-section, at least two substantially plane faces that are substantially parallel to a plane in which axes of the at least two electrical conductors lie.

14. The cable of claim 13, wherein the cable has an approximately rectangular external profile.

15. The cable of claim 13, wherein the cable has, in cross-section, two substantially rounded lateral portions that are joined to the at least two substantially plane faces.

16. The cable of claim 1, wherein the outer jacket has an external outline that substantially matches the common insulating layer.

17. A process for manufacturing the cable of claim 1, the process comprising:

feeding the at least two electrical conductors into a same extrusion head; and extruding the at least one polymeric material over the at least two electrical conductors.

18. A fire-resistant safety cable, comprising:

at least two electrical conductors separated from each other by at least one space;

wherein the cable also comprises a common insulating layer surrounding the at least two electrical conductors, the common insulating layer filling the at least one space and being formed from at least one polymeric material that is adapted to be converted, at least on a surface of the at least one polymeric material, to a ceramic state at high temperatures in a fire, and wherein the cable has, in cross-section, at least two substantially plane faces that are substantially parallel to a plane in which axes of the at least two electrical conductors lie.

19. The cable of claim 18, wherein the at least one polymeric material is a polysiloxane.

20. The cable of claim 18, wherein the at least one polymeric material comprises:

a filler that forms a ceramic under the effect of the high temperatures in a fire.

* * * * *